US006196903B1

(12) United States Patent
Kimura

(10) Patent No.: US 6,196,903 B1
(45) Date of Patent: Mar. 6, 2001

(54) WORKPIECE CARRIER AND POLISHING APPARATUS HAVING WORKPIECE CARRIER

(75) Inventor: Norio Kimura, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/210,899

(22) Filed: Dec. 16, 1998

(30) Foreign Application Priority Data

Dec. 17, 1997 (JP) ..... 9-363953

(51) Int. Cl.[7] ..... B24B 29/00; B24B 5/00
(52) U.S. Cl. ..... 451/285; 451/287
(58) Field of Search ..... 451/398, 288, 451/287, 41, 285

(56) References Cited

U.S. PATENT DOCUMENTS

| | | | | |
|---|---|---|---|---|
| 5,081,795 | | 1/1992 | Tanaka et al. | 451/288 |
| 5,329,732 | | 7/1994 | Karlsrud et al. | 451/289 |
| 5,681,215 | * | 10/1997 | Sherwood et al. | 451/388 |
| 5,716,258 | * | 2/1998 | Metcalf | 451/41 |
| 5,738,568 | * | 4/1998 | Jurjevic et al. | 451/41 |
| 5,795,215 | * | 8/1998 | Guthrie et al. | 451/286 |
| 5,804,507 | * | 9/1998 | Perlov et al. | 438/692 |
| 5,851,140 | * | 12/1998 | Barns et al. | 451/288 |
| 5,938,513 | * | 8/1999 | Slepikas et al. | 451/442 |
| 5,938,884 | * | 8/1999 | Hoshizaki et al. | 156/345 |
| 5,967,885 | * | 10/1999 | Crevasse et al. | 451/285 |

OTHER PUBLICATIONS

Japanese Laid–Open Patent Publication No. 63–62688, by Koichi Tanaka, "Polishing Machin", 1 page.

* cited by examiner

*Primary Examiner*—Rodney A. Butler
(74) *Attorney, Agent, or Firm*—Wenderoth, Lind & Ponack, L.L.P.

(57) ABSTRACT

A workpiece carrier has a top ring body for holding a workpiece, a drive shaft for rotating the top ring body and moving the top ring body toward a turntable to press the workpiece against a polishing surface, and a universal joint for transmitting a pressing force from the drive shaft to the top ring body while allowing the drive shaft and the top ring body to be tilted relatively to each other. The universal joint includes two members having curved surfaces formed along arcs having a predetermined radius of curvature from a center positioned on a surface of the workpiece which is held in contact with the polishing surface on the turntable, and four rollers held in rolling contact with the curved surfaces. Two of the rollers are held in rolling contact with each respective two of the curved surfaces to allow the top ring body to be tilted relatively to the drive shaft about a point positioned on the surface which is held in contact with the polishing surface on the turntable.

18 Claims, 6 Drawing Sheets

WORKPIECE CARRIER AND POLISHING APPARATUS HAVING WORKPIECE CARRIER

BACKGROUND OF THE INVENTION

1. Field of the Invention

The present invention relates to a workpiece carrier for holding a workpiece such as a semiconductor wafer while the workpiece is being polished to make a surface of the workpiece to a flat mirror finish, and a polishing apparatus having such a workpiece carrier.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, and such a process is called Chemical Mechanical polishing.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains (or material) is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated.

If the relative pressure between the semiconductor wafer being polished and the polishing cloth is not uniform over the entire surface of the semiconductor wafer, then the semiconductor wafer tends to be locally polished excessively or insufficiently depending on the applied pressure.

FIG. 6 of the accompanying drawings shows a conventional polishing apparatus. As shown in FIG. 6, a top ring drive shaft 51 has on its lower end a spherical portion 52 which is received in a spherical seat recess 55 defined in an upper surface of a top ring 54 which holds a semiconductor wafer 53 to be polished. The top ring 54 is thus tiltable with respect to the top ring drive shaft 51 so that the top ring 54 follows automatically any possible inclinations of a turntable 56 beneath the top ring 54. The tiltable top ring 54 allows its wafer holding surface 54*a* to be kept parallel to the upper surface of the turntable 56 for uniformizing the relative pressure between the semiconductor wafer 53 and a polishing cloth 57 attached to the upper surface of the turntable 56 over the entire surface of the semiconductor wafer 53.

According to another proposed polishing apparatus, the top ring drive shaft and the spherical portion are separate from each other and includes a top ring drive shaft and a spherical bearing comprising a ball, and the spherical bearing is interposed between the top ring drive shaft and the top ring (see Japanese laid-open patent publication No. 6-198561).

In the polishing apparatus shown in FIG. 6, while the semiconductor wafer 53 is being polished, the top ring drive shaft 51 applies a pressing force F through the top ring 54 to the semiconductor wafer 53, thus developing a frictional force $\mu$F ($\mu$: coefficient of friction) on the surface of the semiconductor wafer 53 slidingly held against the polishing cloth 57. The frictional force $\mu$F produces a rotating moment M=$\mu$FH which tends to tilt the top ring 54 depending on the height H of the center O of the spherical portion 52 from the lower surface of the semiconductor wafer 53 slidingly held against the polishing cloth 57. Because of the rotating moment M, the entire lower surface of the semiconductor wafer 53 cannot uniformly be pressed against the polishing cloth 57. In order to make the moment M zero, it is necessary to make the height H of the center of the spherical portion 52 zero. To meet this requirement, there has been proposed a polishing apparatus having a spherical bearing whose tilting center is positioned on the surface of the semiconductor wafer that is slidingly held against the polishing cloth.

The spherical bearing of the above mentioned proposed polishing apparatus has a convex spherical surface of relatively large area disposed on the upper surface side of the top ring and a concave spherical surface disposed on the lower end side of the top ring drive shaft and held in sliding contact with the convex spherical surface. The top ring is tiltable with respect to the top ring drive shaft due to sliding contact between the convex spherical surface and the concave spherical surface. Because of the sliding contact between the convex and concave spherical surfaces, the top ring cannot follow quickly and smoothly the inclinations of the turntable. Consequently, the wafer holding surface of the top ring and the surface of the turntable may be brought out of parallelism with each other, thus tending to cause the semiconductor wafer to be polished while the semiconductor wafer is being tilted with respect to the polishing cloth.

Another problem is that the convex and concave spherical surfaces of the spherical bearing need to be machined to accurate radii of curvature in order to make the spherical bearing function properly.

SUMMARY OF THE INVENTION

It is therefore an object of the present invention to provide a workpiece carrier which is capable of allowing a top ring to quickly and smoothly follow possible movements (inclinations) of the upper surface of a turntable for thereby keeping a workpiece holding surface of the top ring in parallelism with the upper surface of the turntable.

Another object of the present invention is to provide a polishing apparatus having such a workpiece carrier.

According to the present invention, there is provided a workpiece carrier for holding a workpiece to be polished and pressing the workpiece against a polishing surface on a turntable, comprising: a top ring body for holding the workpiece; a drive shaft for rotating the top ring body and moving the top ring body toward the turntable to press the workpiece against the polishing surface; and a universal joint for transmitting a pressing force from the drive shaft to the top ring body while allowing the drive shaft and the top ring body to be tilted relatively to each other; the universal joint comprising two members having curved surfaces formed along arcs having a predetermined radius of curvature from a center positioned on a surface of the workpiece which is held in contact with the polishing surface on the turntable, and at least four rolling elements held in rolling contact with the curved surfaces; wherein at least two of the rolling elements are held in rolling contact with the respective curved surfaces to allow the top ring body to be tilted relatively to the drive shaft about a point positioned on the surface of the workpiece which is held in contact with the polishing surface on the turntable.

According to the present invention, there is also provided a polishing apparatus for polishing a workpiece, comprising: a turntable having a polishing surface thereon; a top ring body for holding the workpiece; a drive shaft for rotating the top ring body and moving the top ring body toward the turntable to press the workpiece against the polishing surface; and a universal joint for transmitting a pressing force from the drive shaft to the top ring body while allowing the drive shaft and the top ring body to be tilted relatively to each other; the universal joint comprising two members having curved surfaces formed along arcs having a predetermined radius of curvature from a center positioned on a surface of the workpiece which is held in contact with the polishing surface on the turntable, and at least four rolling elements held in rolling contact with the curved surfaces; wherein at least two of the rolling elements are held in rolling contact with the respective curved surfaces to allow the top ring body to be tilted relatively to the drive shaft about a point positioned on surface of the workpiece which is held in contact with the polishing surface on the turntable.

According to the present invention, since a moment which is caused by a frictional force acting on the surface to be polished of the workpiece during polishing and causes the top ring to be tilted is made zero, a workpiece holding surface of the top ring can be kept parallel to the upper surface of the turntable for thereby allowing the workpiece to be polished highly accurately. When the top ring is tilted to follow any possible inclinations of the upper surface of the turntable, the two members which perform the relative motion move relatively to each other in accordance with rolling contact, rather than sliding contact, of the rolling elements. As a consequence, the top ring can quickly and smoothly follow any possible movements of the upper surface of the turntable.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

A workpiece carrier and a polishing apparatus having such a workpiece carrier will be described below with reference to FIGS. 1 through 5.

Figure 1:
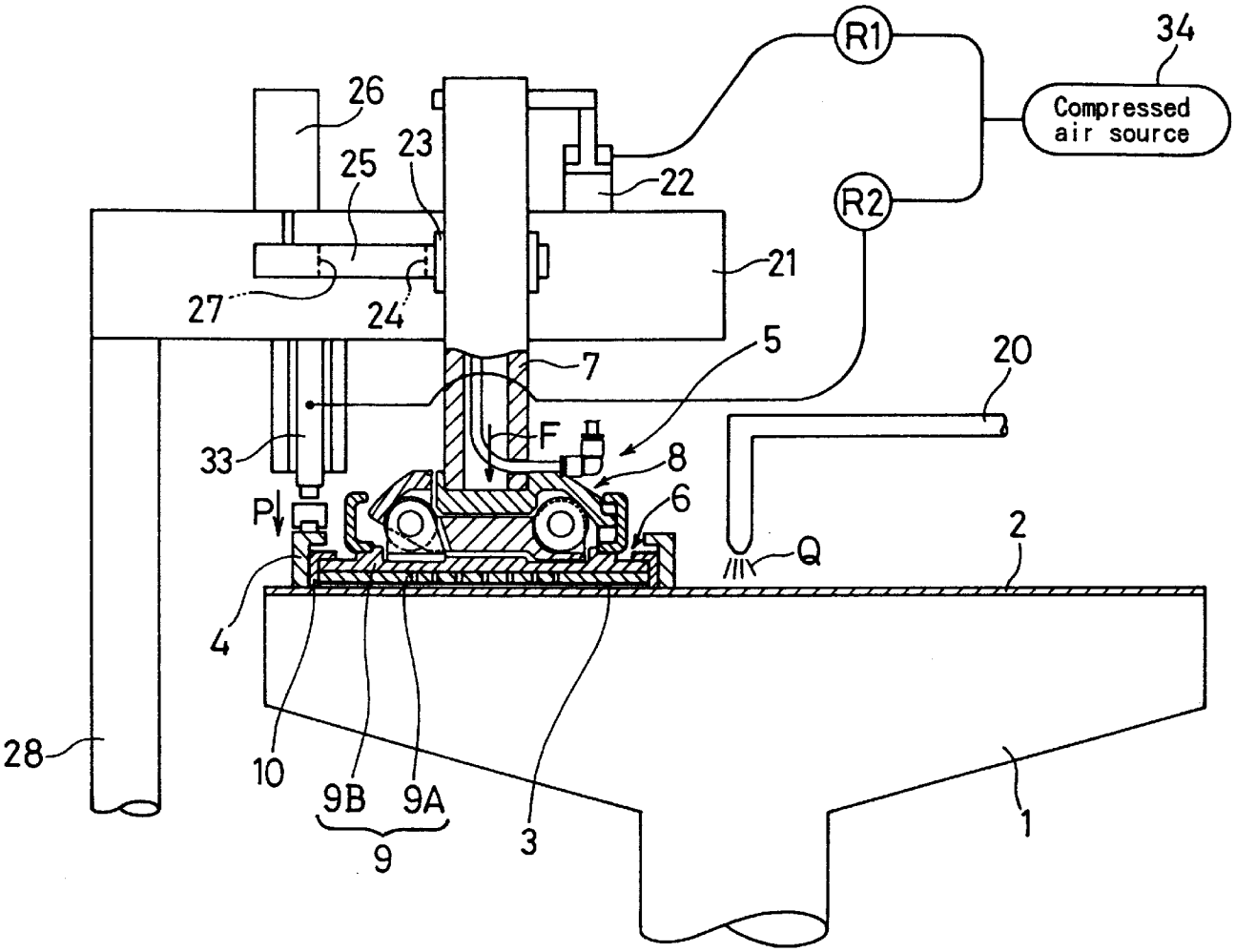
FIG. 1 is a fragmentary side elevational view, partly in cross section, of a polishing apparatus according to the present invention.
Figure 2:
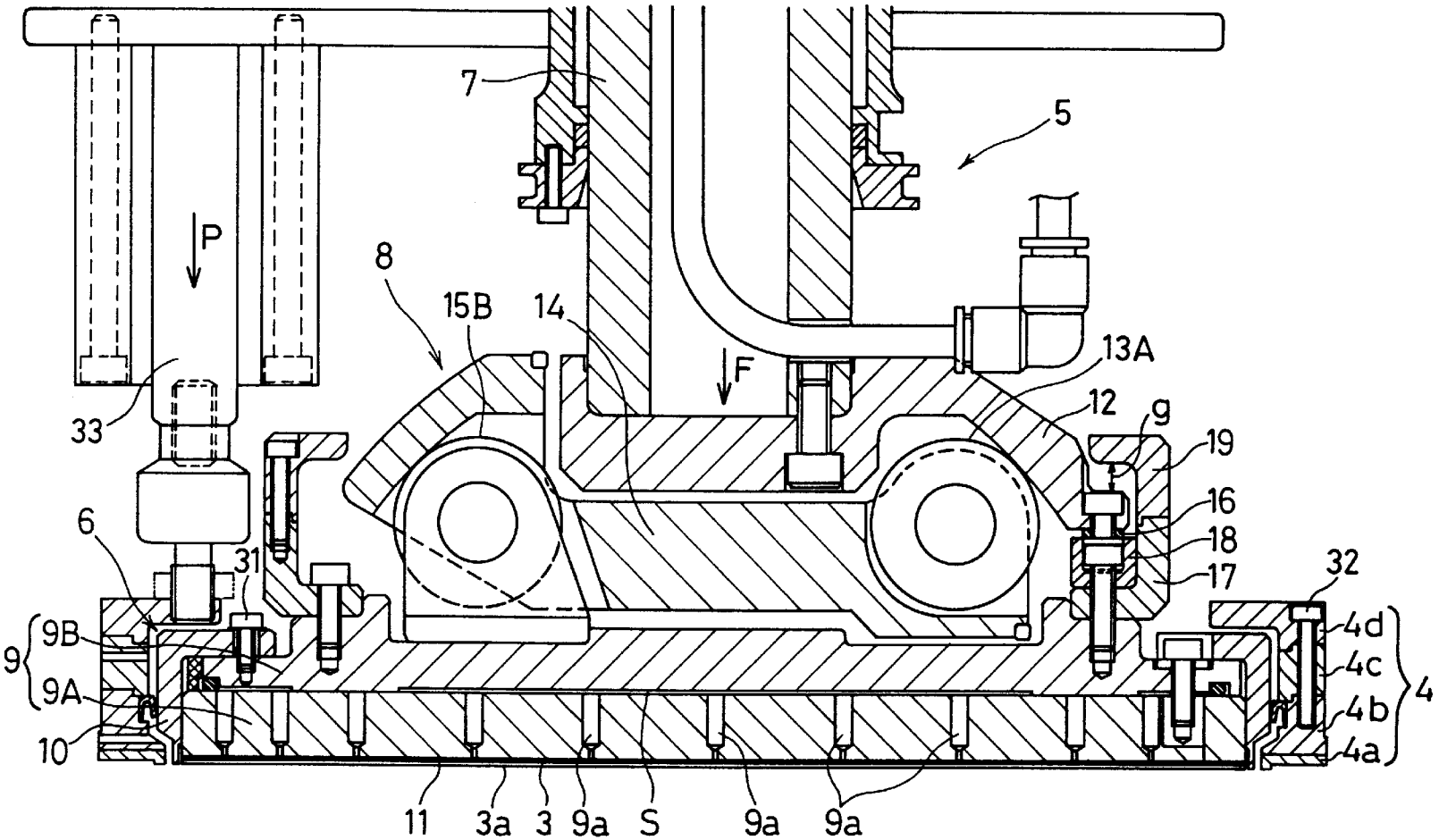
FIG. 2 is an enlarged cross-sectional view of a workpiece carrier of the polishing apparatus shown in FIG. 1.

As shown in FIGS. 1 and 2, a polishing apparatus according to the present invention has a turntable 1 with a polishing cloth 2 mounted on an upper surface thereof, and a workpiece carrier 5 for holding a semiconductor wafer 3 as a workpiece and pressing the semiconductor wafer 3 against the polishing cloth 2. The workpiece carrier 5 comprises a top ring 6 for holding the semiconductor wafer 3, a top ring drive shaft 7 for supporting the top ring 6 and transmitting a pressing force and a rotational drive force to the top ring 6, and a universal joint 8 for transmitting the pressing force and the rotational drive force from the top ring drive shaft 7 to the top ring 6 while allowing the top ring drive shaft 7 and the top ring 6 to be tilted relatively to each other. An abrasive liquid supply nozzle 20 is positioned above the turntable 1 for supplying an abrasive liquid Q containing abrasive material to the polishing cloth 2 on the turntable 1. The upper surface of the polishing cloth 2 constitutes a polishing surface on the turntable 1.

As shown in FIG. 2, the top ring 6 comprises a top ring body 9 comprising a lower carrier plate 9A and an upper carrier plate 9B that are coupled to each other, and a retainer ring 10 disposed around and fastened to an outer circumferential edge of the top ring body 9 by bolts 31. The semiconductor wafer 3 has an upper surface held by a lower workpiece holding surface of the top ring body 9, and an outer circumferential edge held by the retainer ring 10. A presser ring 4 is vertically movably disposed around the top ring body 9 and the retainer ring 10. An elastic pad 11 is attached to the lower workpiece holding surface of the top ring body 9. Therefore, the semiconductor wafer 3 is supported by the workpiece holding surface through the elastic pad 11.

Figure 3:
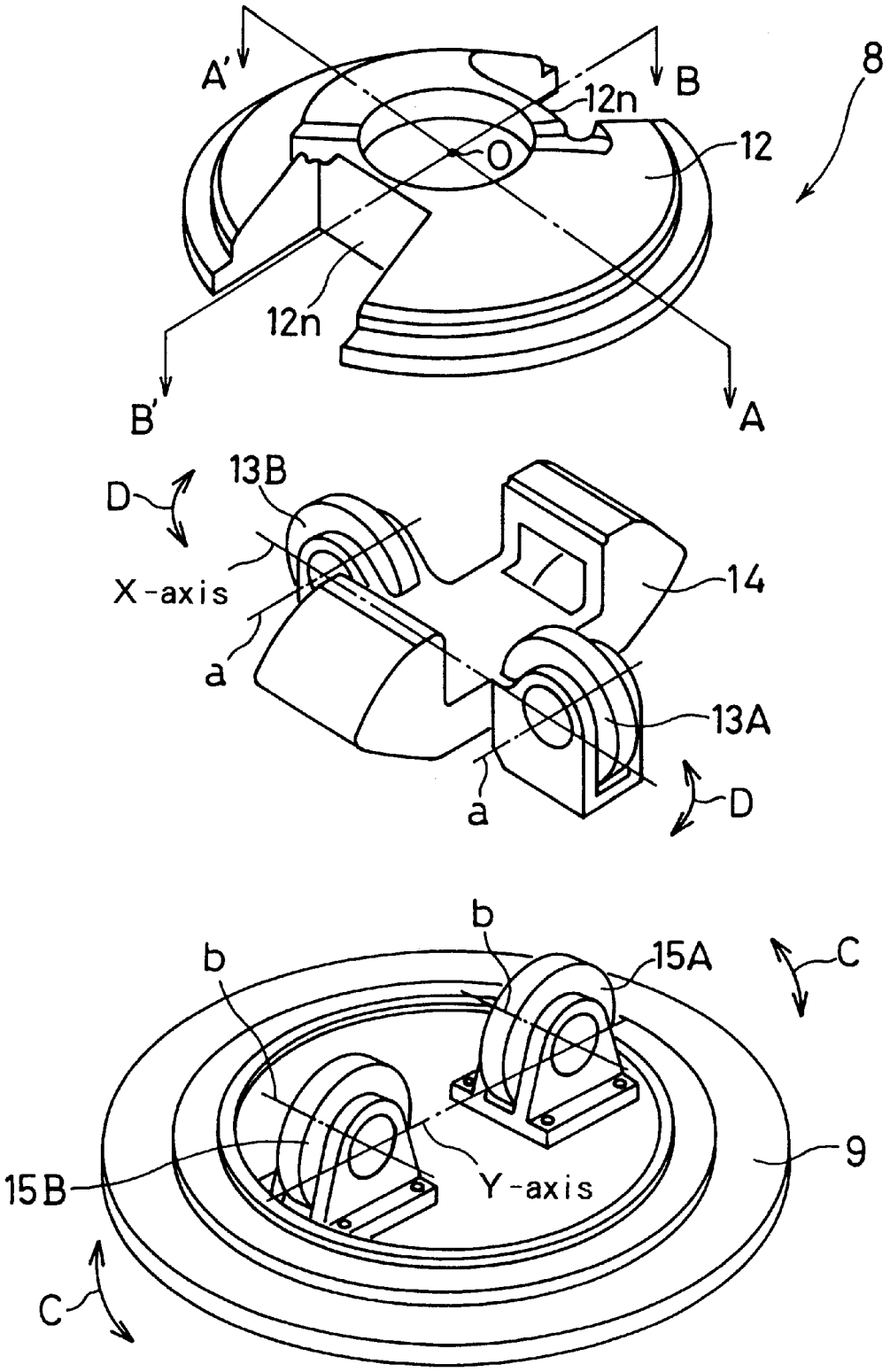
FIG. 3 is an exploded perspective view of a universal joint of the workpiece carrier shown in FIG. 2.

FIG. 3 shows in exploded perspective the universal joint 8 which interconnects the top ring 6 and the top ring drive shaft 7.

As shown in FIG. 3, the universal joint 8 comprises a substantially circular drive flange 12 fixed to the lower end of the top ring drive shaft 7, an intermediate rocking member 14 supporting a pair of spaced rollers 13A, 13B arranged along an X-axis, and a pair of rollers 15A, 15B mounted on an upper surface of the top ring body 9 and arranged along a Y-axis perpendicular to the X-axis. The drive flange 12 has a pair of diametrically opposite recesses 12*n* defined therein and opening radially outwardly, and the intermediate rocking member 14 has opposite ends accommodated respectively in the recesses 12*n*. The rollers 13A, 13B are rotatable about respective axes "a" which extend perpendicularly to the X-axis, and the rollers 15A, 15B are rotatable about respective axes "b" which extend perpendicularly to the Y-axis.

Figure 4A:
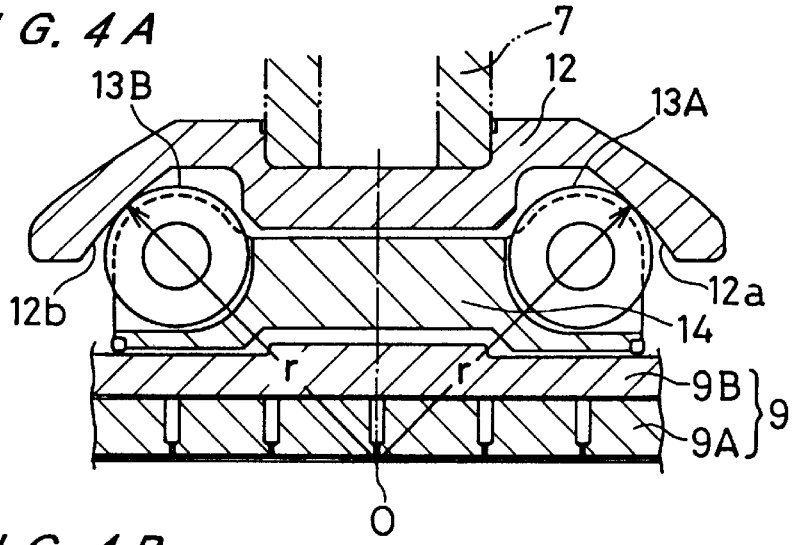
FIG. 4A is a cross-sectional view taken along line A-O-A' of FIG. 3.
Figure 4B:
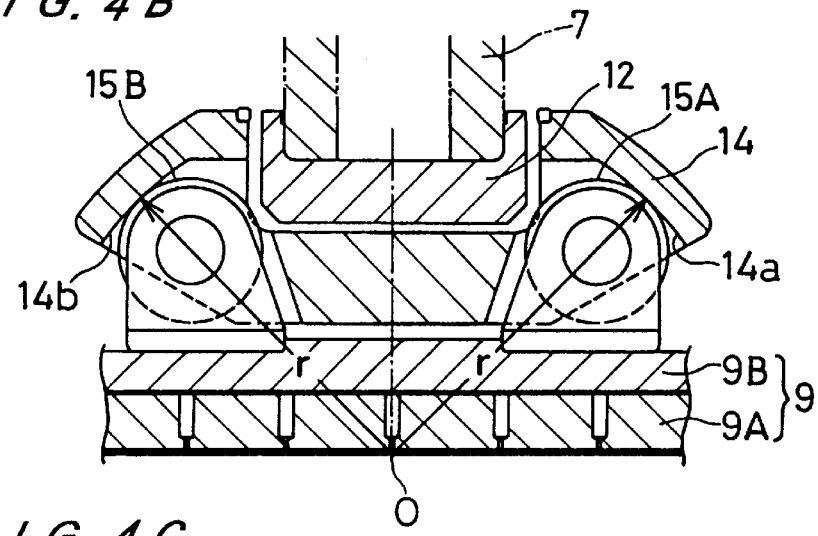
FIG. 4B is a cross-sectional view taken along line B-O-B' of FIG. 3.
Figure 4C:
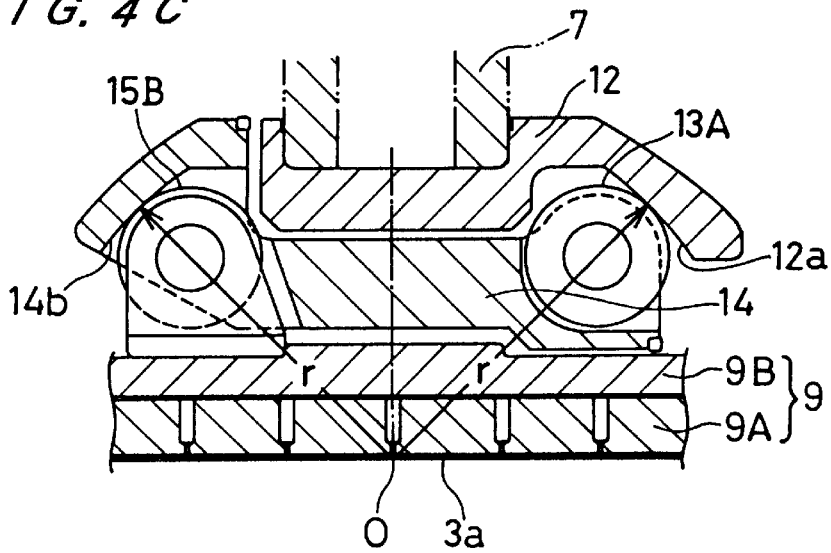
FIG. 4C is a cross-sectional view taken along line A-O-B' of FIG. 3.

FIGS. 4A through 4C show the universal joint 8 as it is assembled. As shown in FIG. 4A, the drive flange 12 has a pair of curved surfaces 12*a*, 12*b* on its lower surface, each having a radius "r" of curvature from a center O. The rollers 13A, 13B on the intermediate rocking member 14 are held in rolling engagement with the curved surfaces 12*a*, 12*b*, respectively.

As shown in FIG. 4B, the intermediate rocking member 14 has a pair of curved surfaces 14*a*, 14*b* on its lower surface, each having the radius "r" of curvature from the center O. The rollers 15A, 15B on the top ring body 9 are held in rolling engagement with the curved surfaces 14*a*, 14*b*, respectively.

As shown in FIG. 4C, the curved surfaces 12*a*, 12*b* and 14*a*, 14*b* are formed along respective two arcs perpendicular to each other, each having the radius "r" of curvature from the center O. The center O is positioned on the surface of the semiconductor wafer 3 slidingly held against the polishing cloth 2, i.e., the surface 3*a* of the semiconductor wafer 3 which is to be polished. Operation of the universal joint 8 constructed as shown in FIGS. 4A through 4C will be described later on.

Figure 5:
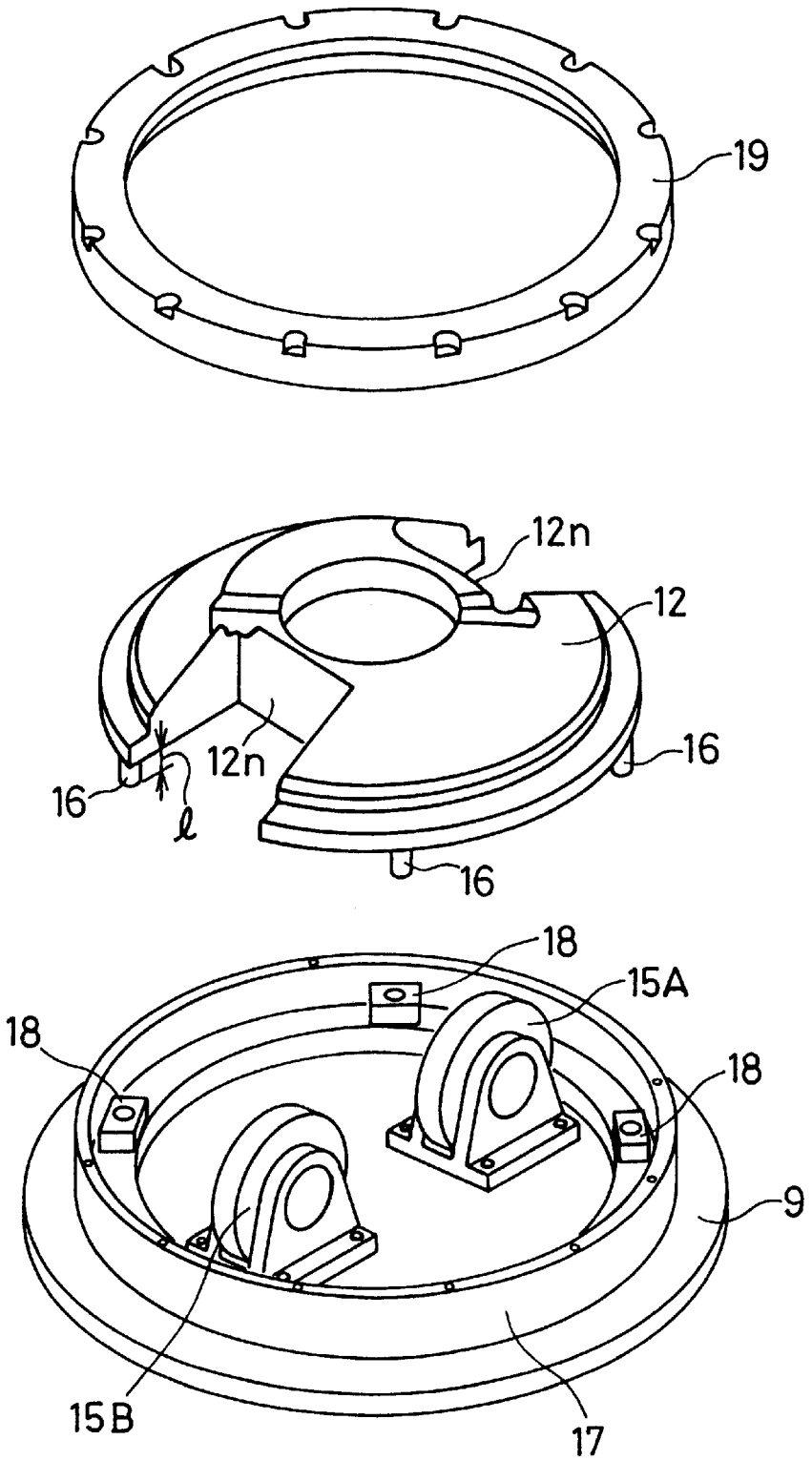
FIG. 5 is an exploded perspective view of a torque transmitting mechanism of the workpiece carrier shown in FIG. 2.
Figure 6:
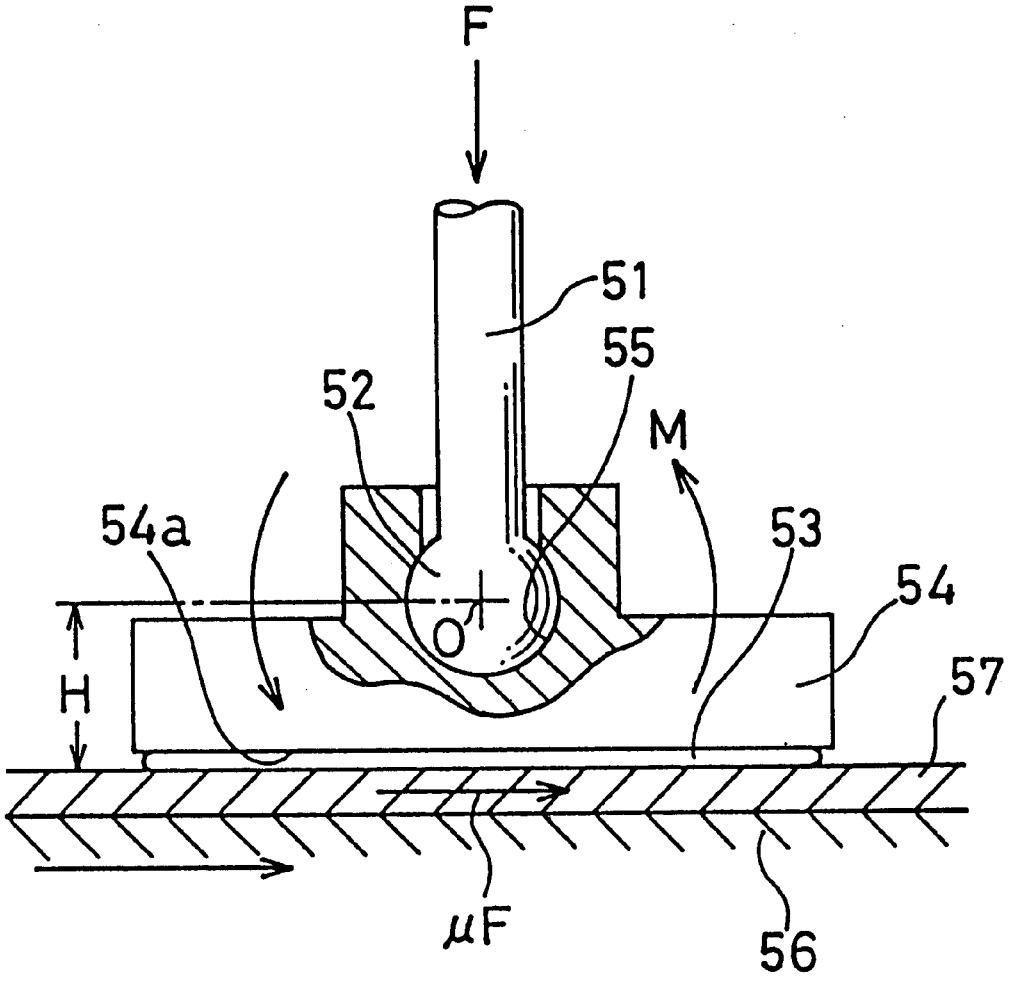
FIG. 6 (PRIOR ART)
FIG. 6 is an enlarged fragmentary side elevational view, partly in cross section, of a conventional polishing apparatus.

FIG. 5 shows in exploded perspective a torque transmitting mechanism of the workpiece carrier 5, the torque transmitting mechanism comprising components disposed around the drive flange 12. Specifically, as shown in FIGS. 2 and 5, a plurality of circumferentially spaced torque transmitting pins 16 are fixed to and project downwardly from the lower surface of the drive flange 12. An annular member 17 having an L-shaped cross-section is fixed to the upper surface of an outer circumferential side of the top ring body 9. A plurality of torque transmitting blocks 18, each in the shape of a rectangular parallelepiped, are fixedly mounted at circumferentially spaced locations on an upper surface of the annular member 17. The torque transmitting pins 16 are held in engagement with the torque transmitting blocks 18, respectively, for transmitting a torque from the top ring drive shaft 7 to the top ring body 9. Thus, the top ring body 9 is rotated about its own axis. Another annular member 19 having an inverted L-shaped cross-section and the same diameter as the annular member 17 is placed on and fixed to the annular member 17.

As shown in FIG. 2, a gap S is formed between the lower carrier plate 9A and the upper carrier plate 9B. The gap S can be supplied with a vacuum, a pressurized air, or a liquid such as water from sources (not shown). The top ring body 9 has a plurality of holes 9*a* defined vertically therethrough in communication with the gap S and opening downwardly at the lower surface of the top ring body 9. The elastic pad 11 also has a plurality of openings (not shown) defined therein in alignment and communication with the holes 9*a*. Accordingly, the upper surface of the semiconductor wafer 3 held against the elastic pad 11 can be attracted thereto by a vacuum developed in the gap S, or can be supplied with a liquid or a pressurized air through the gap S.

As shown in FIG. 1, the top ring drive shaft 7 is operatively connected to a top ring air cylinder 22 fixedly mounted on a top ring head 21. The top ring drive shaft 7 can be moved vertically by the top ring air cylinder 22. When the top ring drive shaft 7 is lowered by the top ring air cylinder 22, the semiconductor wafer 3 held on the lower surface of the top ring 6 is pressed against the polishing cloth 2 on the turntable 1.

The top ring drive shaft 7 is coupled by a key (not shown) to a sleeve 23 having a timing pulley 24 therearound. The timing pulley 24 is operatively connected by a timing belt 25 to a timing pulley 27 mounted on the drive shaft of a top ring motor 26. The top ring motor 26 is fixedly mounted on the top ring head 21. When the top ring motor 26 is energized, the sleeve 23 and the top ring drive shaft 7 are integrally rotated by the top ring motor 26 through the timing pulley 27, the timing belt 25, and the timing pulley 24, and thus the top ring 6 is rotated about its own axis. The top ring head 21 is supported by a top ring head shaft 28 vertically supported by an apparatus frame (not shown).

As shown in FIG. 2, the presser ring 4 disposed around the top ring 6 comprises a first presser ring member 4*a* made of alumina ceramics which is disposed in a lowermost position, second and third presser ring members 4*b*, 4*c* made of stainless steel which are successively disposed upwardly of the first presser ring member 4*a*, and a fourth presser ring member 4*d* made of stainless steel which is disposed in an uppermost position. The second, third and fourth presser ring members 4*b*, 4*c*, 4*d* are interconnected by bolts 32, and the first presser ring member 4*a* is fixed to the second presser ring member 4*b* by adhesion or the like. The first presser ring member 4*a* has a stepped lower surface whose radially inner circumferential portion projects downwardly to provide a pressing surface for pressing the polishing cloth 2 (see FIG. 1). The presser ring 4 has an upper end coupled to a plurality of presser ring air cylinders 33 (e.g. three such air cylinders) which are fixed to the top ring head 21. The presser ring air cylinders 33 are arranged in a circular array coaxial to the presser ring 4.

As shown in FIG. 1, the top ring air cylinder 22 and the presser ring air cylinders 33 are connected to a compressed air source 34 through respective pressure regulators R1, R2. The pressure regulator R1 regulates a pressure of air supplied to the top ring air cylinder 22 for adjusting the pressing force that is applied by the top ring 6 to press the semiconductor wafer 3 against the polishing cloth 2. The pressure regulator R2 regulates a pressure of air supplied to the presser ring air cylinders 33 for adjusting the pressing force that is applied to the polishing cloth 2 by the presser ring 4.

The polishing apparatus having a structure shown in FIGS. 1 through 5 operates as follows:

A semiconductor wafer 3 to be polished is held on the lower surface of the top ring 6. Thereafter, the top ring air cylinder 22 is actuated to move the top ring 6 toward the turntable 1 and then to press the semiconductor wafer 3 against the polishing cloth 2 on the turntable 1 which is rotating. An abrasive liquid containing abrasive grains (or material) is supplied from the abrasive liquid supply nozzle 20 onto the polishing cloth 2 and retained on the polishing cloth 2. Therefore, the lower surface of the semiconductor wafer 3 is polished in the presence of the abrasive liquid between the lower surface of the semiconductor wafer 3 and the polishing cloth 2. The rotation of the top ring drive shaft 7 is transmitted to the top ring body 9 through the torque transmitting pins 16 fixed to the drive flange 12 and the torque transmitting blocks 18 fixed to the top ring body 9.

At this time, even if the upper surface of the turntable 1 is slightly tilted, the top ring body 9 is quickly tilted with respect to the top ring drive shaft 7 by the universal joint 8. Specifically, the top ring body 9 is tilted with respect to the top ring drive shaft 7 in the following manner:

As shown in FIGS. 3 and 4A–4C, since the rollers 15A, 15B on the top ring body 9 roll respectively on the curved surfaces 14*a*, 14*b* of the intermediate rocking member 14, the top ring body 9 can be tilted in a vertical plane including the Y-axis as indicated by the arrows C. Since the rollers 13A, 13B on the intermediate rocking member 14 roll respectively on the curved surfaces 12*a*, 12*b* of the drive flange 12, the intermediate rocking member 14 can be tilted in a vertical plane including the X-axis as indicated by the arrows D. When the intermediate rocking member 14 is tilted in the vertical plane including the X-axis, the top ring body 9 is also tilted in unison with the intermediate rocking member 14 in the vertical plane including the X-axis because there is no relative motion between the top ring body 9 and the intermediate rocking member 14 as to the vertical plane including the X-axis. Therefore, the top ring body 9 can be tilted simultaneously in the two vertical planes perpendicular to each other, i.e., can make a composite motion composed of tilting movements in two directions. Accordingly, the top ring body 9 can be tilted in all vertical planes in an angle of 3600, and hence the top ring body 9 can be tilted to follow any possible inclinations of the upper surface of the turntable 1.

Inasmuch as the curved surfaces 12*a*, 12*b* of the drive flange 12 and the curved surfaces 14*a*, 14*b* of the intermediate rocking member 14 are formed along the respective arcs each having the radius "r" of curvature from the center O, the top ring body 9 is tiltable about the center O. The center O about which the top ring body 9 is tiltable coincides with the point of application where the frictional force $\mu$F (see FIG. 1) acts on the surface 3*a* of the semiconductor wafer 3 which is being polished. Accordingly, the moment M which is produced by the frictional force $\mu$F and causes the top ring body 9 to be tilted is made zero ($M=\mu F\times 0$), so that the lower wafer holding surface of the top ring body 9 can be kept parallel to the upper surface of the turntable 1.

When any adjacent two of the top ring body 9, the intermediate rocking member 14 and the drive flange 12 move relatively to each other, the relative motion between those two members is performed by the rolling contact of the rollers 13A, 13B or the rollers 15A, 15B. Consequently, the top ring body 9 can quickly and smoothly follow any possible inclinations of the upper surface of the turntable 1.

The top ring body 9 is made tiltable with respect to the top ring drive shaft 7 by providing two members having curved surfaces with a given radius of curvature, and rolling elements such as rollers held in rolling contact with the curved surfaces. Since a spherical bearing comprising convex and concave spherical surfaces does not need to be employed between the top ring body 9 and the top ring drive shaft 7, no accurate machining is required.

While the semiconductor wafer 3 is being polished, the pressing force F applied from the top ring air cylinder 22 through the top ring 6 to press the semiconductor wafer 3 against the polishing cloth 2 on the turntable 1 can be adjusted by the pressure regulator R1. Depending on the pressing force F, the pressing force P applied from the presser ring air cylinders 33 through the presser ring 4 to the polishing cloth 2 can be adjusted by the pressure regulator R2. Therefore, during the polishing process, the pressing force P that is applied by the presser ring 4 to the polishing cloth 2 can be varied depending on the pressing force F that is applied by the top ring 6 to press the semiconductor wafer 3 against the polishing cloth 2.

After polishing the semiconductor wafer 3, the top ring 6 is lifted away from the turntable 1. At this time, when the top ring drive shaft 7 is lifted by the top ring air cylinder 22, the upper surface of an outer circumferential portion of the drive flange 12 is brought into contact with the annular member 19, and hence the top ring 6 is lifted together with the top ring drive shaft 7. The torque transmitting pins 16 have a length "1" (see FIG. 5) longer than a gap "g" (see FIG. 2) between the upper surface of the outer circumferential portion of the drive flange 12 and the lower surface of a radially inner flange of the annular member 19. Therefore, when the top ring 6 is lifted together with the top ring drive shaft 7, the torque transmitting pins 16 do not disengage from the torque transmitting blocks 18, and the drive flange 12 and the top ring 6 are prevented from rotating relatively to each other.

In the illustrated embodiment, the rollers 13A, 13B and 15A, 15B in the form of short cylinders are employed as rolling elements. However, balls may be employed as rolling elements.

In the illustrated embodiments, the curved surfaces 12*a*, 14*b* and 12*b*, 14*a* of the drive flange 12 and the intermediate rocking member 14 are formed as respective two arcuate surfaces perpendicular to each other. However, the curved surfaces 12*a*, 14*b* and 12*b*, 14*a* of the drive flange 12 and the intermediate rocking member 14 may be formed as curved surfaces having at least two different directional components.

As is apparent from the above description, according to the present invention, since a moment which is caused by a frictional force acting on the surface to be polished of the workpiece during polishing and causes the top ring to be tilted is made zero, a workpiece holding surface of the top ring can be kept parallel to the upper surface of the turntable for thereby allowing the workpiece to be polished highly accurately. When the top ring is tilted to follow any possible inclinations of the upper surface of the turntable, the two members which perform the relative motion move relatively to each other in accordance with rolling contact, rather than sliding contact, of the rolling elements. As a consequence, the top ring can quickly and smoothly follow any possible movements of the upper surface of the turntable.

Further, in order to make the top ring tiltable, it is functionally and structually sufficient to provide two members having curved surfaces with a given radius of curvature and rolling elements such as rollers held in rolling contact with the respective curved surfaces. Thus, a spherical bearing comprising convex and concave spherical surfaces is not required to be formed, and hence highly accurate machining is not required.

Although a certain preferred embodiment of the present invention has been shown and described in detail, it should be understood that various changes and modifications may be made therein without departing from the scope of the appended claims.

What is claimed is:

1. A workpiece carrier for holding a workpiece to be polished and pressing the workpiece against a polishing surface of a turntable, said workpiece carrier comprising:

a top ring body for holding the workpiece;

a drive shaft for rotating said top ring body and moving said top ring body in a direction to be toward the turntable to press the workpiece against the polishing surface; and a universal joint for transmitting a pressing force from said drive shaft to said top ring body while allowing said drive shaft and said top ring body to be tilted relative to each other, said universal joint comprising:

a first member having at least one first curved surface having a radius of curvature centered at a position beyond said top ring body and to be on a surface of the workpiece in contact with the polishing surface of the turntable;

a second member having at least one second curved surface having a radius of curvature centered at said position; and at least four rolling elements including a first pair of rolling elements held in rolling contact with said at least one first curved surface and a second pair of rolling elements held in rolling contact with said at least one second curved surface, said first pair of rolling elements not contacting said at least one second curved surface, and said second pair of rolling elements not contacting said at least one first curved surface, such that said top ring body may be tilted about said position relative to said drive shaft.

2. A workpiece carrier as claimed in claim 1, wherein said first member comprises a drive flange fixed to said drive shaft, said second member comprises an intermediate rocking member movable with respect to said drive flange, said first pair of rolling elements being mounted on said intermediate rocking member, and said second pair of rolling elements being mounted on said top ring body.

3. A workpiece carrier as claimed in claim 1, wherein said rolling elements comprise rollers.

4. A workpiece carrier as claimed in claim 1, wherein said rolling elements comprise balls.

5. A workpiece carrier as claimed in claim 1, wherein said first pair of rolling elements are rotatable about axes extending in a first direction, and said second pair of rolling elements are rotatable about axes extending in a second direction orthogonal to said first direction.

6. A workpiece carrier as claimed in claim 1, wherein said at least one first curved surface comprises two first curved surfaces positioned on opposite sides of said first member, and said two first curved surfaces are curved with respect to said radius of curvature only.

7. A workpiece carrier as claimed in claim 6, wherein said at least one second curved surface comprises two second curved surfaces positioned on opposite sides of said second member, and said two second curved surfaces are curved with respect to said radius of curvature only.

8. A workpiece carrier as claimed in claim 1, wherein said at least one second curved surface comprises two second curved surfaces positioned on opposite sides of said second member, and said two second curved surfaces are curved with respect to said radius of curvature only.

9. A workpiece carrier as claimed in claim 2, wherein said universal joint her comprises a first torque transmitting member fixed to said drive flange, and a second torque transmitting member fixed to said top ring body, said first and second torque transmitting members being held in engagement with each other and thereby transmitting rotation from said drive shaft to said top ring body.

10. A polishing apparatus for polishing a workpiece, said polishing apparatus comprising:

a turntable having thereon a polishing surface;

a top ring body for holding the workpiece;

a drive shaft for rotating said top ring body and moving said top ring body in a direction to be toward said turntable to press the workpiece against said polishing surface; and a universal joint for transmitting a pressing force from said drive shaft to said top ring body while allowing said drive shaft and said top ring body to be tilted relative to each other, said universal joint comprising:

a first member having at least one first curved surface having a radius of curvature centered at a position beyond said top ring body and to be on a surface of the workpiece in contact with the polishing surface of said turntable;

a second member having at least one second curved surface having a radius of curvature centered at said position; and at least four rolling elements including a first pair of rolling elements held in rolling contact with said at least one first curved surface and a second pair of rolling elements held in rolling contact with said at least one second curved surface, said first pair of rolling elements not contacting said at least one second curved surface, and said second pair of rolling elements not contacting said at least one first curved surface, such that said top ring body may be tilted about said position relative to said drive shaft.

11. An apparatus as claimed in claim 10, wherein said first member comprises a drive flange fixed to said drive shaft, said second member comprises an intermediate rocking member movable with respect to said drive flange, said first pair of rolling elements being mounted on said intermediate rocking member, and said second pair of rolling elements being mounted on said top ring body.

12. An apparatus as claimed in claim 10, wherein said rolling elements comprise rollers.

13. An apparatus as claimed in claim 10, wherein said rolling elements comprise balls.

14. An apparatus as claimed in claim 10, wherein said first pair of rolling elements are rotatable about axes extending in a first direction, and said second pair of rolling elements are rotatable about axes extending in a second direction orthogonal to said first direction.

15. An apparatus as claimed in claim 10, wherein said at least one first curved surface comprises two first curved surfaces positioned on opposite sides of said first member, and said two first curved surfaces are curved with respect to said radius of curvature only.

16. An apparatus as claimed in claim 10, wherein said at least one second curved surface comprises two second curved surfaces positioned on opposite sides of said second member, and said two second curved surfaces are curved with respect to said radius of curvature only.

17. An apparatus as claimed in claim 11, wherein said universal joint further comprises a first torque transmitting member fixed to said drive flange, and a second torque transmitting member fixed to said top ring body, said first and second torque transmitting members being held in engagement with each other and thereby transmitting rotation from said drive shaft to said top ring body.

18. An apparatus as claimed in claim 15, wherein said at least one second curved surface comprises two second curved surfaces positioned on opposite sides of said second member, and said two second curved surfaces are curved with respect to said radius of curvature only.

* * * * *

UNITED STATES PATENT AND TRADEMARK OFFICE

CERTIFICATE OF CORRECTION

PATENT NO. : 6,196,903 B1
DATED : March 6, 2001
INVENTOR(S) : Norio Kimura et al.

It is certified that error appears in the above-identified patent and that said Letters Patent is hereby corrected as shown below:

Column 9, claim 9,
Line 2, change "her" to -- further --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*